US007303653B2

(12) United States Patent
Yuasa

(10) Patent No.: US 7,303,653 B2
(45) Date of Patent: Dec. 4, 2007

(54) SIZING AGENT AND RECORDING SHEET HAVING THE SAME

(75) Inventor: Toshiya Yuasa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 10/720,216

(22) Filed: Nov. 25, 2003

(65) Prior Publication Data

US 2004/0105995 A1 Jun. 3, 2004

(30) Foreign Application Priority Data

Nov. 28, 2002 (JP) ..... 2002-345706
Jul. 17, 2003 (JP) ..... 2003-198459

(51) Int. Cl.
*D21H 23/22* (2006.01)

(52) U.S. Cl. ..... 162/168.2; 164/158; 164/164.1; 164/164.6; 164/184; 106/287.23

(58) Field of Classification Search ..... 162/158, 162/164.1, 164.6, 168.2, 184; 106/287.23
See application file for complete search history.

(56) References Cited

U.S. PATENT DOCUMENTS 4,446,174 A 5/1984 Maekawa et al. ..... 427/261
4,542,059 A 9/1985 Toganoh et al. ..... 428/141
4,758,461 A 7/1988 Akiya et al. ..... 428/212
5,478,631 A * 12/1995 Kawano et al. ..... 428/32.1
5,712,027 A * 1/1998 Ali et al. ..... 428/32.3
6,033,524 A 3/2000 Pruszynski et al. ..... 162/165
6,221,957 B1 * 4/2001 Nzudie et al. ..... 524/815
6,270,881 B1 8/2001 Yuasa et al. ..... 428/211
6,465,078 B1 * 10/2002 Kawai et al. ..... 428/32.26
2002/0100567 A1 8/2002 Lindgren et al. ..... 162/168.1
2002/0139502 A1 * 10/2002 Hallstrom et al. ..... 162/168.3
2002/0160162 A1 * 10/2002 Kawai et al. ..... 428/195
2003/0212183 A1 * 11/2003 Struck et al. ..... 524/460
2004/0241347 A1 * 12/2004 Tsujihata et al. ..... 428/32.1

FOREIGN PATENT DOCUMENTS

EP 0 444 788 A1 9/1991
JP 59-35977 A 2/1984
JP 1-135682 A 5/1989
JP 10-119425 A 5/1998
WO WO 03/064767 A1 8/2003

* cited by examiner

*Primary Examiner*—Eric Hug
*Assistant Examiner*—Dennis R. Cordray
(74) *Attorney, Agent, or Firm*—Fitzpatrick, Cella, Harper & Scinto

(57) ABSTRACT

A sizing agent includes a vinyl copolymer having a repeating unit (i) having a quaternary amino group and a repeating unit (ii) derived from acrylic monomers having a hydrophilic polyoxyethylene, the ratio by mass, (i):(ii), of the repeating unit (i) to the repeating unit (ii) being 60:40 to 90:10. A recording sheet having the sizing agent is also provided.

2 Claims, No Drawings

SIZING AGENT AND RECORDING SHEET HAVING THE SAME

BACKGROUND OF THE INVENTION

1. Field of the Invention

The present invention relates to a sizing agent and to a recording sheet having the same to provide plain paper that is moderate in price and provides printed images having superior properties, such as good print density, color-forming properties, water-resistance, light-resistance, and non-bleeding. In particular, the invention provides plain paper suitable for ink-jet recording of full-color images.

2. Description of the Related Art

Ink-jet printers are widely used not only as output units of, for example, personal computers, but also as printing devices for printing on various kinds of materials. Ink used for ink-jet printers is generally composed of solutions produced by dissolving organic dyes into water and other solvents. The organic dyes include azo dyes, anthraquinone dyes, indigo dyes, phthalocyanine dyes, carbonium ion dyes, nitro dyes, quinoline dyes, and naphthoquinone dyes.

Printing on plain paper, which is a recording medium, using the above ink causes feathering, i.e., the deterioration of clear characters and images. Specifically, as the ink permeates, it bleeds along fibers in the paper. Unfortunately, the dots bleed severely and the periphery of the dots becomes jagged and blurred. Furthermore, the ink does not have sufficient water-resistance and light-resistance for recording images using ink-jet printers.

Dedicated coated paper having an ink-absorbing layer composed of a superabsorbent polymer thereon has been used in order to achieve clear color development and to prevent ink bleeding (see, for example, Japanese Patent Laid-Open Nos. 59-35977 and 1-135682). Unfortunately, because of the special coating, the paper is more costly to manufacture than plain paper, and lacks the texture that plain paper has. Accordingly, there has been an increased demand for low-cost plain paper for general purpose use in ink-jet printers.

In view of the above problems, plain paper for ink-jet recording is proposed, which has a coating solution applied to it. The coating solution comprises a cationic polymer, which is an active component, having a structure of (meth) acrylamide alkyl quaternary ammonium salt having a benzyl group, and a water-soluble resin (see, for example, Japanese Patent Laid-Open No. 10-119425).

However, in order to meet the recent demand for further improved ink durability, in particular, the demand for water-resistance and light-resistance of the ink for ink-jet recording of full-color images, further improvement in image-fastness is still desirable.

SUMMARY OF THE INVENTION

Accordingly, it is an object of the present invention to provide a recording sheet, i.e., recording paper, that is moderate in price, provides superior printed images having a good print density, good color-forming properties, and has superior properties due to the rapid permeation of ink deposited on the paper while suppressing the spread of ink dots, thereby preventing bleeding and strike-through. The recording sheet has superior water-resistance and light-resistance. In particular, the present invention provides a recording sheet suitable for ink-jet recording of full-color images.

Accordingly, a sizing agent of the present invention comprises a vinyl copolymer having a repeating unit (i) represented by general formula (1) and a repeating unit (ii) represented by general formula (2), the ratio by mass, (i):(ii), of the repeating unit (i) to the repeating unit (ii) being 60:40 to 90:10:

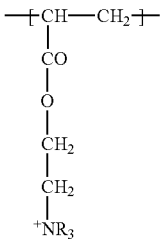

(1)

wherein R represents an alkyl group of 1 to 10 carbon atoms, and the alkyl group may be branched;

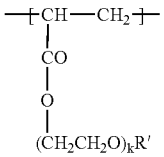

(2)

wherein R' represents an alkyl group of 1 to 10 carbon atoms, the alkyl group may be branched, and k represents a real number of 1 to 3.

The recording sheet according to the present invention includes fibrous pulps, fillers, and the above sizing agent.

The sizing agent according to the present invention provides a recording sheet, i.e., recording paper, that is moderate in price, provides superior printed images having a good print density, good color-forming properties, and superior properties due to the rapid permeation of ink deposited on the paper while preventing bleeding and strike-through of the ink, and provides a recording sheet having superior water-resistance and light-resistance. In particular, the sizing agent according to the present invention provides a recording sheet suitable for ink-jet recording of full-color images. Furthermore, unlike known dedicated coated paper, the recording sheet of the present invention has almost the same properties, such as the surface configuration and the physical properties, as those of known neutral plain paper copier (PPC) paper. Therefore, the recording sheet of the present invention can be used as paper both for electrophotographic recording using a toner and for ink-jet recording.

Further objects, features and advantages of the present invention will become apparent from the following description of the preferred embodiments.

DESCRIPTION OF THE PREFERRED EMBODIMENTS

The copolymer used in the present invention may be a vinyl copolymer produced by copolymerizing a side-chain cationic monomer and a hydrophilic monomer. According to the present invention, coloring materials in ink permeate inward to the paper layer of the recording sheet, and are associated with a cationic polymer in the recording sheet by ionic interaction, and then the coloring materials quickly separate from the solution phase, thereby further improving the fixing and color-forming properties of the ink. In the vinyl copolymer, the ratio by mass, (i):(ii), of the repeating unit (i) to the repeating unit (ii) is in the range of 60:40 to 90:10. The vinyl copolymer includes an amount of the repeating unit (i) larger than that of the repeating unit (ii). As a result, the vinyl copolymer provides a recording sheet having outstanding water-resistance and light-resistance.

The vinyl copolymer used in the present invention is a copolymer having the repeating unit (i) having a quaternary amino group and the repeating unit (ii) derived from acrylic monomers having a hydrophilic polyoxyethylene.

A segment composed of the repeating unit (i) mainly contributes to fixing the dyes and is represented by general formula (1) indicated below:

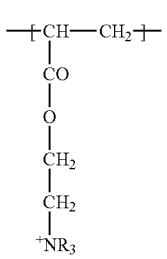

(1)

wherein R represents an alkyl group of 1 to 10 carbon atoms, and the alkyl group may be branched.

The alkyl group of 1 to 10 carbon atoms may be branched, and examples of the alkyl group preferably include methyl, ethyl, and propyl groups, in particular, a methyl group. The alkyl group may have substituents such as nitro, carboxyl, and sulfone groups. Three Rs are each the same or different, but preferably the same.

The quaternary amino group is prepared by adding, for example, an alkyl halide to an alkylamino group. The monomer used to obtain the repeating unit (i) is preferably an N,N-dimethylamino ethylacrylate-methylchloride quaternary compound, N,N-diethylamino ethylacrylate-ethylchloride quaternary compound, or N,N-dipropylamino ethylacrylate-propylchloride quaternary compound, in particular, an N,N-dimethylamino ethylacrylate-methylchloride quaternary compound.

The counter-ion for the quaternary amino group includes, for example, chloride and bromide ions.

A segment composed of the repeating unit (ii) allows the rapid absorption of water and the dyes dissolved or suspended in water, and is represented by general formula (2) indicated below:

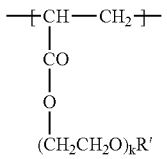

(2)

wherein R' represents an alkyl group of 1 to 10 carbon atoms, the alkyl group may be branched, and k represents a real number of 1 to 3.

The alkyl group of 1 to 10 carbon atoms may be branched, and examples of the alkyl group preferably include methyl, ethyl, and propyl groups, in particular, a methyl group. The alkyl group may have substituents such as nitro, carboxyl, and sulfone groups.

The polyoxyethylene is prepared by condensing ethylene glycol in the presence of halogenated ethylene and an alkali. The monomer used to obtain the repeating unit (ii) is preferably methoxy triethylene glycol acrylate, ethoxy diethylene glycol acrylate, or methoxy diethylene glycol acrylate, in particular, methoxy triethylene glycol acrylate.

The ratio by mass, (i):(ii), of the repeating unit (i) to the repeating unit (ii) is 60:40 to 90:10, preferably 70:30 to 85:15. An excess of the repeating unit (ii) causes ink bleeding and does not provide sufficient color-forming properties, water-resistance and light-resistance of the images. On the other hand, a shortage of the repeating unit (ii) deteriorates the ink absorbability and does not provide sufficient color-forming properties.

The vinyl copolymer according to the present invention preferably has a weight-average molecular weight of about 20,000 to 60,000. A cationic polymer having too large an average molecular weight is too viscous to have good coating properties.

According to the present invention, both of the repeating units have a good affinity in terms of their molecular structures, and furthermore, the ratio of the repeating units is highly preferable. Therefore, the present invention provides superior advantages.

To prepare the sizing agent of the present invention, the vinyl copolymer is diluted with a solvent, such as water, to obtain a satisfactory density for application. Specifically, the sizing agent preferably includes the vinyl copolymer in the ratio of 0.2 percent by mass to 20 percent by mass, more preferably, 1 percent by mass to 10 percent by mass.

Components other than the copolymer may be added to the sizing agent, as long as the advantages of the present invention are not seriously impaired. Examples of the other components include water-soluble resins, water-dispersible resins, surfactants, pH adjusters, antiseptics, oxidation inhibitors, ultraviolet absorbers, water-resistant agents, fluorescent brighteners, and surface-sizing agents.

Examples of the water-soluble resins include starch, polyacrylamide, polyvinylpyrrolidone, water-soluble cellulose, (such as carboxymethyl cellulose, hydroxymethyl cellulose, and hydroxypropyl cellulose), polyvinyl methyl ether, polyethylene oxide, and polyvinyl alcohol.

Examples of the water-dispersible resins include polyvinyl acetate, ethylene-vinylacetate copolymer, polystyrene, styrene-(meth)acrylate copolymers, (meth)acrylate copolymers, vinylacetate-(meth)acrylate copolymers, styrene-isoprene copolymer, styrene-butadiene copolymer, ethylene-propylene copolymer, polyvinyl ethers, and silicone-acrylic copolymers. The water-dispersible resins are not limited to the above resins. A cross-linking agent, such as methylolmelamine, methylolurea, methylolhydroxypropyleneurea, and isocyanates may be used. Furthermore, a self cross-linkable copolymer including a repeating unit of, for example, N-methylolacrylamide may also be used. These aqueous resins may be used alone or in combination.

The sizing agent according to the present invention may include other paper-sizing agents used in general papermaking processes. Examples of the other sizing agents include a rosin-sizing agent, an alkylketene dimer, an alkenyl succinic anhydride, oxidized starch, a sizing agent based on a petroleum resin, epichlorohydrin, acrylamide, styrene-butadiene rubber (SBR) latex, a polymer including a hydrophilic portion and a hydrophobic portion therein, for example, acrylic emulsion and styrene-acrylic copolymer, and water-repelling materials, such as silicone oil, paraffin, wax, and a fluorine compounds.

The surfactants include anion activators, ampholytic surfactants, and nonionic active agents. Preferably, the use of the nonionic active agents enhances the densities of the images and mitigates the problem of ink bleeding.

Examples of the surfactants include higher alcohol-ethylene oxide adducts, alkylphenol-ethylene oxide adducts, fatty acid-ethylene oxide adducts, polyol fatty acid ester-ethylene oxide adducts, higher alkylamine-ethylene oxide adducts, fatty acid amide-ethylene oxide adducts, fatty acid-ethylene oxide adducts, polypropylene glycol-ethylene oxide adducts, glycerol fatty acid esters, pentaerythritol fatty acid esters, sorbitol fatty acid esters, sorbitan fatty acid esters, sucrose fatty acid esters, and polyol alkyl ethers. The surfactants are not limited to the above. The surfactants may enhance the densities of the images and mitigate the problem of ink bleeding.

Other components, for example, alumina powder, silica powder, natural inorganic powders, and resinous emulsions may be added to the sizing agent according to the present invention.

Furthermore, cationic compounds other than the above cationic polymer may be added in order to further improve the durability of the images, as long as the object of the present invention can be achieved. The cationic compounds are not limited as long as the cationic compounds include a cationic segment in the molecule. The cationic polymer used in the present invention provides the ink with the fixing and color-forming properties. While permeating into the recording sheet, the coloring materials in the ink are associated with the cationic polymer disposed on the surface of the recording sheet by ionic interaction, and then the coloring materials quickly separate from the solution phase, thereby further improving the fixing and color-forming properties of the ink.

The cationic polymer used in the present invention is a hydrophilic polymer including a repeating unit having a cationic group. Examples of the cationic polymer include hydrophilic synthetic resins, such as polyacrylic resins, polyvinyl resins, and polyallyl resins, and natural resins, such as cationic starch. The cationic group is not limited as long as the cationic group has an affinity to the ink for use in an ink-jet printer. The most preferable cationic polymer is a hydrophilic polymer having a quaternary amino group, which is the cationic group. Examples of the cationic polymer include poly(allylamine hydrochloride), poly (amine sulfonate), poly(vinylamine hydrochloride), chitosan hydrochloride, cationic starch, polyvinylpyrrolidone-aminoalkylalkylate quaternary salt copolymer, and acrylamide-aminomethyl acrylamide quaternary salt copolymer. The cationic polymer is not limited to the above compounds. The cationic compound is not limited as long as the cationic compound includes a cationic segment in the molecule. In the present invention, cationic compounds other than the cationic compounds described in the present invention are not considered to be an essential component but rather an auxiliary component.

Base paper used in the present invention is of standard make and includes chemical pulps, such as Laubholz bleached kraft pulp (LBKP) and Nadelholz bleached kraft pulp (NBKP), and fillers and may include a sizing agent and auxiliary agents for papermaking. The pulp may also include mechanical pulps and recycled paper pulps or may be mainly composed of mechanical pulps and recycled paper pulps. The fillers include calcium carbonate, kaolin, talc, clay, and titanium dioxide.

The recording sheet of the present invention is made by applying or impregnating the sizing agent of the present invention on the surface of the completed base paper or on the surface of the base paper in a papermaking machine during the papermaking process. Size pressing may be applied on one side or both sides of the paper. Due to the size pressing, the ink is associated with the cationic polymer disposed on the surface of the recording sheet by ionic interaction and quickly separates from the solution phase, thereby further improving the fixing and color-forming properties of the ink.

The method for applying or impregnating the sizing agent to make the recording sheet is not limited to size pressing. The sizing agent may be coated on the base paper by, for example, roll coating, blade coating, air-knife coating, gate-roll coating, bar coating, spray coating, gravure coating, and curtain coating. Size pressing is preferably used because it provides appropriate printing properties, suppresses ink-absorbing property, and improves the paper strength. After the coating process, the recording sheet is dried with, for example, a hot air dryer or a heating drum, thereby producing the recording sheet of the present invention.

The sizing agent of the present invention is applied or impregnated on the base paper such that the paper contains a mass of 0.1 to 20 $g/m^2$ in terms of the solid content of the sizing agent, preferably 0.5 to 10 $g/m^2$ in terms of the solid content. According to the present invention, the sizing agent is applied or impregnated preferably on the surface of the completed base paper or on the surface of the base paper in a papermaking machine during the papermaking process. The sizing agent of the present invention may be mixed with the paper ingredients and may be used as an internal sizing agent. In that case, however, a large amount of sizing agent is required in order to achieve a good effect.

The pH of a recording sheet processed with the sizing agent of the present invention is preferably adjusted so that the pH of its extracted water is range of 5 to 9, more preferably to 6 to 8. The pH of extracted water is defined as follows: A specimen (about 1.0 g) provided in accordance with Japanese Industrial Standard (hereinafter referred to as JIS) P8133 is soaked in distilled water (70 mL). Then the pH of the extracted solution is measured in accordance with JIS Z8802.

Deviation from the pH range decreases the long-term preservation ability of the paper and the color-forming properties of the dyes on the paper. The Stöckigt sizing degree of the recording sheet produced in the above way is preferably from 0 to 50 seconds. A low Stöckigt sizing degree causes bleeding of ink drops and prevents clear images and characters from being formed. On the other hand, a high Stöckigt sizing degree prevents the ink from being absorbed into the paper and impairs fixing and drying of the ink.

The recording sheet of the present invention has almost the same properties, i.e., not only the recording property but also the surface configuration and the physical properties, as those of known neutral plain paper copier (PPC) paper. Therefore, the recording sheet of the present invention can be used as paper both for electrophotographic recording using a toner and for ink-jet recording.

EXAMPLES

The present invention will now be described with reference to the following examples, which are not directed to limiting the scope of the present invention.

Example 1

A sizing agent shown in Table 1 was applied to a base plain paper of 80 g/m$^2$ with an experimental size pressing apparatus such that the paper contained 5 g/m$^2$ in terms of the mass of the solid content of the sizing agent, and then the resultant paper was dried at 100° C. for 5 minutes to produce a recording sheet.

A vinyl copolymer used as the sizing agent shown in Table 1 had a ratio by mass, (i):(ii), of a repeating unit (i) to a repeating unit (ii) of 80:20. The sizing agent was used to produce the recording sheet.

TABLE 1

| Composition of Sizing Agent | Parts by Mass |
|---|---|
| Copolymer (1) | 40 |
| PVA 217 (2) | 10 |
| SK-20 (3) | 45 |
| SKS-257 (4) | 1 |
| Pulset JK-173 (5) | 10 |
| Water | 1233.3 |

(1) Copolymer including a cationic polymer; N,N-dimethylamino ethylacrylate-methylchloride quaternary salt, i.e., the repeating unit (i), (80 parts by mass; in terms of mass of the solid content), methoxy triethylene glycol acrylate i.e., the repeating unit (ii), (20 parts by mass; in terms of mass of the solid content),a surfactant (6) (3 parts by mass), and V-50, i.e., an initiator, (Wako Pure Chemical Industries, Ltd.) (5 parts by mass) were dissolved in water (300 parts by mass), and then the mixture was subjected to emulsion polymerization at 70° C. for four hours, thereby producing the cationic polymer (weight-average molecular weight: 30,000).
(2) polyvinyl alcohol (Kuraray Co., Ltd.)
(3) oxidized starch (Nihon Cornstarch Corporation)
(4) surface-sizing agent; alkylketene dimer (Arakawa Chemical Industries, Ltd.)
(5) cationic polymer (Meisei Chemical Works, Ltd.)
(6) New-col 1525 (Nippon Nyukazai Co., Ltd.)

Full-color images were printed on the recording sheet produced above with an ink-jet printer (Color Bubble Jet™ printer BJS700, CANON KABUSHIKI KAISHA). The printed samples were evaluated for their color-forming properties, water-resistance, light-resistance, and strike-through.

The color-forming properties were evaluated with a calorimeter (Macbeth Spectrolino, Gretag Macbeth) by measuring the optical density (OD) of the printed images. Table 2 below summarizes the evaluation results. A large OD value in Table 2 indicates a high optical density. In order to evaluate the water-resistance, the printed paper was tilted upward by 45 degrees from the vertical, and water was allowed to flow over the paper from the upper part of the printed paper. The deformation of the image and ink bleeding were evaluated by visual observation. In order to evaluate the light-resistance, the printed paper was irradiated with xenon light (0.39 W/m$^2$) for 30 hours with an Atlas Fade Meter Ci-4000. Then the OD value was measured with the colorimeter (Macbeth Spectrolino, Gretag Macbeth). The residual percentage (%) of OD was calculated by the following formula: (OD value after irradiation/OD value before irradiation)×100. The light-resistance was evaluated by the residual percentage (%) of OD for each color. In order to evaluate the strike-through of the ink, the reverse side of the printed paper was evaluated by visual observation. In Table 2, symbol A indicates superior, symbol B indicates satisfactory, symbol C indicates slightly inferior, and symbol D indicates significantly inferior.

Example 2

A sizing agent was prepared as in Example 1 to produce a recording sheet but the ratio by mass, (i):(ii), of the repeating unit (i) to the repeating unit (ii) was 75:25 and the copolymer had a weight-average molecular weight of 30,000. The resultant recording sheet was evaluated as in Example 1. Table 2 shows the results.

Example 3

A sizing agent was prepared as in Example 1 to produce a recording sheet but the ratio by mass, (i):(ii), of the repeating unit (i) to the repeating unit (ii) was 85:15 and the copolymer had a weight-average molecular weight of 50,000. The resultant recording sheet was evaluated as in Example 1. Table 2 shows the results.

Example 4

A sizing agent was prepared as in Example 1 to produce a recording sheet but the repeating unit (i) was N,N-diethylamino ethylacrylate-ethylchloride quaternary salt. The resultant recording sheet was evaluated as in Example 1. Table 2 shows the results.

Example 5

A sizing agent was prepared as in Example 1 to produce a recording sheet but the repeating unit (ii) was ethoxy diethylene glycol acrylate. The resultant recording sheet was evaluated as in Example 1. Table 2 shows the results.

Comparative Example 1

A sizing agent was prepared as in Example 1 to produce a recording sheet but the ratio by mass, (i):(ii), of the repeating unit (i) to the repeating unit (ii) was 50:50 and the copolymer had a weight-average molecular weight of 40,000. The resultant recording sheet was evaluated as in Example 1. Table 2 shows the results.

Comparative Example 2

A sizing agent was prepared as in Example 1 to produce a recording sheet but the ratio by mass, (i):(ii), of the repeating unit (i) to the repeating unit (ii) was 95:5 and the copolymer had a weight-average molecular weight of 30,000. The resultant recording sheet was evaluated as in Example 1. Table 2 shows the results.

Comparative Example 3

A recording sheet not having the sizing agent of the present invention, i.e., a high-grade plain paper (KA4250NPD, EPSON) was evaluated as in Example 1. Table 2 shows the results.

Comparative Example 4

A sizing agent was prepared as in Example 1 to produce a recording sheet but only N,N-dimethylamino ethylacrylate-benzylchloride quaternary compound was used as the monomer, which was polymerized to produce the cationic polymer. The resultant recording sheet was evaluated as in Example 1. Table 2 shows the results.

Comparative Example 5

A sizing agent was prepared as in Example 1 to produce a recording sheet but only N,N-dimethylamino propylacrylamide-methylchloride quaternary compound was used as the monomer, which was polymerized to produce the cationic polymer. The resultant recording sheet was evaluated as in Example 1. Table 2 shows the results.

TABLE 2

| | Color-Forming Properties (Optical Density) | | | | Water- | Light-Resistance (%) | | | | Strike- |
|---|---|---|---|---|---|---|---|---|---|---|
| | Yellow | Magenta | Cyan | Black | Resistance | Yellow | Magenta | Cyan | Black | Through |
| Example 1 | 0.92 | 1.12 | 1.13 | 1.40 | A | 97 | 76 | 71 | 91 | A |
| Example 2 | 0.95 | 1.11 | 1.12 | 1.39 | A | 99 | 82 | 87 | 94 | A |
| Example 3 | 0.94 | 1.14 | 1.16 | 1.37 | A | 99 | 89 | 93 | 92 | A |
| Example 4 | 0.93 | 1.15 | 1.11 | 1.36 | A | 98 | 85 | 82 | 96 | A |
| Example 5 | 0.94 | 1.13 | 1.12 | 1.38 | A | 99 | 81 | 86 | 89 | A |
| Comparative Example 1 | 0.77 | 1.03 | 0.98 | 1.14 | C | 88 | 24 | 38 | 73 | B |
| Comparative Example 2 | 0.79 | 0.96 | 1.10 | 1.11 | A | 98 | 34 | 42 | 81 | C |
| Comparative Example 3 | 0.70 | 0.93 | 1.06 | 1.13 | B | 96 | 43 | 54 | 75 | C |
| Comparative Example 4 | 0.72 | 0.89 | 1.01 | 1.09 | C | 92 | 44 | 57 | 77 | D |
| Comparative Example 5 | 0.81 | 0.92 | 1.03 | 1.20 | C | 86 | 38 | 48 | 74 | C |

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A process for producing a recording sheet comprising fibrous pulps, fillers, and a sizing agent, comprising:

a step of applying the sizing agent to a base paper, the sizing agent comprising a vinyl copolymer, wherein in the vinyl copolymer, the only kinds of repeating units are selected from a repeating unit (i) represented by general formula (1) and a repeating unit (ii) represented by general formula (2), the ratio by mass, (i):(ii), of the repeating unit (i) to the repeating unit (ii) being 60:40 to 90:10:

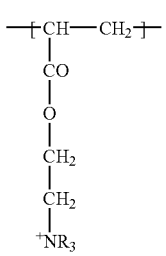

(1)

wherein R represents an alkyl group of 1 to 10 carbon atoms, and the alkyl group may be branched,

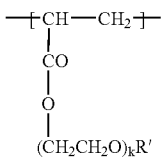

(2)

wherein R' represents an alkyl group of 1 to 10 carbon atoms, the alkyl group may be branched, and k represents a real number of 1 to 3, and wherein the vinyl copolymer has a weight-average molecular weight of about 20,000 to 60,000, and the content of the vinyl copolymer is in the ratio of 0.2 percent by mass to 20 percent by mass of the sizing agent.

2. The process according to claim 1, wherein R in general formula (1) is a methyl group, R' in general formula (2) is a methyl group, and k in general formula (2) is 3.

* * * * *

UNITED STATES PATENT AND TRADEMARK OFFICE

CERTIFICATE OF CORRECTION

PATENT NO. : 7,303,653 B2
APPLICATION NO. : 10/720216
DATED : December 4, 2007
INVENTOR(S) : Toshiya Yuasa It is certified that error appears in the above-identified patent and that said Letters Patent is hereby corrected as shown below:

COLUMN 4:
Line 64, “rosin-sizing” should read --resin-sizing--.

COLUMN 6:
Line 38, “range” should read --in a range--.

COLUMN 7:
Line 27, “content),a” should read --content), a--.
Line 42, “calo-” should read --colo- --.

Signed and Sealed this

Twelfth Day of August, 2008

JON W. DUDAS
*Director of the United States Patent and Trademark Office*